US005144127A

United States Patent [19]

Williams et al.

[11] Patent Number: 5,144,127

[45] Date of Patent: Sep. 1, 1992

[54] SURFACE INDUCED DISSOCIATION WITH REFLECTRON TIME-OF-FLIGHT MASS SPECTROMETRY

[76] Inventors: Evan R. Williams, 1177 Amarillo Ave., Apt. #9, Palo Alto, Calif. 94303; Richard N. Zare, 724 Santa Ynez, Stanford, Calif. 94305

[21] Appl. No.: 739,904

[22] Filed: Aug. 2, 1991

[51] Int. Cl.[5] ..... H01J 49/40

[52] U.S. Cl. ..... 250/287; 250/281; 250/282

[58] Field of Search ..... 250/287, 282, 281

[56] References Cited

U.S. PATENT DOCUMENTS

| | | | |
|---|---|---|---|
| 4,731,532 | 3/1988 | Frey et al. | 250/287 |
| 4,851,669 | 7/1989 | Aberth | 250/281 |
| 4,988,879 | 1/1991 | Zare et al. | 250/423 P |
| 5,032,722 | 7/1991 | Boesl et al. | 250/287 |

OTHER PUBLICATIONS

Cooks et al., "Collisions of Polyatomic Ions with Surfaces," *International Journal of Mass Spectrometry and Ion Processes, 100* (1990) 209–265.

Bier et al., "Tandem Mass Spectrometry Using an In--Line Ion-Surface Collision Device," *International Journal of Mass Spectrometry and Ion Processes, 103* (1990) 1–19.

Schey et al., "Ion/Surface Collision Phenomena in an Improved Tandem Time-of-Flight Instrument," *International Journal of Mass Spectrometry and Ion Processes, 94* (1989) 144–157.

Bier et al., "A Tandem Quadrupole Mass Spectrometer For the Study of Surface-Induced Dissociation," *International Journal of Mass Spectrometry and Ion Processes, 77* (1987) 31–47.

Beavis et al., "Factors Affecting the Ultraviolet Laser Desorption of Proteins," *Rapid Communications in Mass Spectrometry, 3*, no. 7, (1989) 233–37.

Karas et al., "Ultraviolet-Laser Desorption/Ionization Mass Spectrometry of Femtomolar Amounts of Large Proteins," *Biomedical and Environmental Mass Spectrometry, 18* (1989) 841–843.

Ding et al., "Surface≧Induced Reactions of Benzene and Pyridine," *Proc. 39th ASMS Conf. on Mass Spectrom. & Allied Topics*, May, 1991, Nashville, Tenn.

*Primary Examiner*—Jack I. Berman

*Attorney, Agent, or Firm*—Majestic, Parsons, Siebert & Hsue

[57] ABSTRACT

Surface induce dissociation (SID) in a reflectron tandem time-of-flight mass spectrometer is demonstrated using a movable "in-line" SID surface in the reflectron lens. For collisions under 100 eV, SID spectra are measured with a resolution of ~65 (FWHM) with dissociation efficiencies of 7–15% obtained for most small organic ions. For larger peptide ions ($m/z > 1200$) formed by laser desorption, efficiencies as high as 30–50% are obtained. Surface collisions of polycyclic aromatic hydrocarbon ions can be made to produce abundant pick-up of large, surface-adsorbed species. Attachment of $C_1H_n$ -$C_6H_n$ to naphthalene and phenanthrene ions occurs with collision energies between 40–160 eV. Formation efficiency for these ion-adsorbate attachment reactions can be as high as 0.8%. Surface collisions produce no measureable shift in our flight times nor distortion in peak shapes for these species; this indicates the reaction time on the surface must be less thant 160 ns. Theoretical calculations show that these reactions are direct (<300 fs residence on the surface) and thus proceed by an Eley-Rideal mechanism.

19 Claims, 5 Drawing Sheets

SURFACE INDUCED DISSOCIATION WITH REFLECTRON TIME-OF-FLIGHT MASS SPECTROMETRY

This invention was made with U.S. Government support under grant number CHE-8907477, awarded by the National Science Foundation. The government has certain rights to this invention.

FIELD OF THE INVENTION

The present invention relates generally to apparatus and methods for performing mass spectrometric analysis of material samples and, more specifically, to a technique for dissociating ions for tandem mass spectrometry in reflectron time-of-flight mass spectrometry.

BACKGROUND OF THE INVENTION

Mass spectrometry is a widely accepted analytical technique for the accurate determination of molecular weights, the identification of chemical structures, the determination of the composition of mixtures and quantitative elemental analysis. It can accurately determine the molecular weights of organic molecules and determine the structure of the organic molecules based on the fragmentation pattern of the ions formed when the molecule is ionized.

Mass spectrometry relies on the production of ionized fragments from a material sample and subsequent quantification of the fragments based on mass and charge. Typically, positive or negative ions are produced from the sample and accelerated to form an ion beam. Differing mass fractions within the beam are then selected using a mass analyzer, such as single-focusing or double-focusing magnetic mass analyzer, a time-of-flight mass analyzer, a quadrupole mass analyzer, or the like. A spectrum of fragments having different masses can then be produced, and the compound(s) within the material sample identified based on the spectrum.

An improved form of mass spectrometry, referred to as tandem mass spectrometry or MS/MS has been developed where a mass-selected ion beam (referred to as the parent ion stream) produced by a first mass analyzer is dissociated into a plurality of daughter ion fragments. The daughter ion fragments are then subjected to a second stage of mass analysis, allowing mass quantification of the various daughter ion fractions. Such tandem mass spectrometry has been found to provide much more information on the material being analyzed and to allow for improved discrimination between various species that may be present in a particular sample.

In combination with "soft" ionization techniques, MS/MS can be a powerful characterization method for mixtures, separating individual molecular ions, and obtaining structural information by dissociating each followed by product ion mass analysis. New ionization methods, such as matrix assisted laser desorption are capable of producing singly charged ions from biomolecules in the 100,000 molecular weight range. However, collisionally activated dissociation (CAD), the most widely used method of MS/MS is ineffective at breaking apart singly charged ions with $m/z > 3000$. Using surface collisions in hybrid instruments, it has been demonstrated that high internal energy can be deposited into small ions, with internal energy deposition controlled by varying the collision energy. Bier et al., *Int. J. Mass Spectrom. Ion Proc.*, 1987, 31–47, and references cited therein. Such high internal energy deposition shows promise for promoting structurally useful dissociations in large ions. For extending these measurements to large biomolecules, time-of-flight (TOF) mass spectrometry has the advantages of virtually unlimited mass range and multichannel detection.

SUMMARY OF THE INVENTION

It is an object, of the present invention to provide an improved TOF mass spectrometer for MS/MS experiments.

It is another object of the invention to provide a reflectron TOF instrument using a moveable metal surface in the reflectron region that is capable of surface-induced dissociation.

It is a further object of the invention is to provide a tandem mass spectrometer in which ions, upon surface collisions, pick-up large, surface-absorbed species.

Yet another object of the invention is to provide a tandem mass spectrometer in which mass selected ions are used to characterize a surface of unknown composition.

These and other objects are accomplished with the inventive time-of-flight mass spectrometer system having a reflectron that comprises two grid decelerating electrodes positioned within the aperture of a series of diaphragm ring shaped reflectron lens (or mirrors). Mounted in the aperture behind decelerating electrode is a moveable, variable potential surface-induced dissociation (SID) surface that can be maneuvered within the aperture.

Surface-induced dissociation has been achieved in the inventive reflectron time-of-flight instrument. In addition, large species such as $C_6H_{0-4}$ can also be attached to polycyclic aromatic hydrocarbon (PAH) ions

DESCRIPTION OF THE PREFERRED EMBODIMENT

Figure 1A:
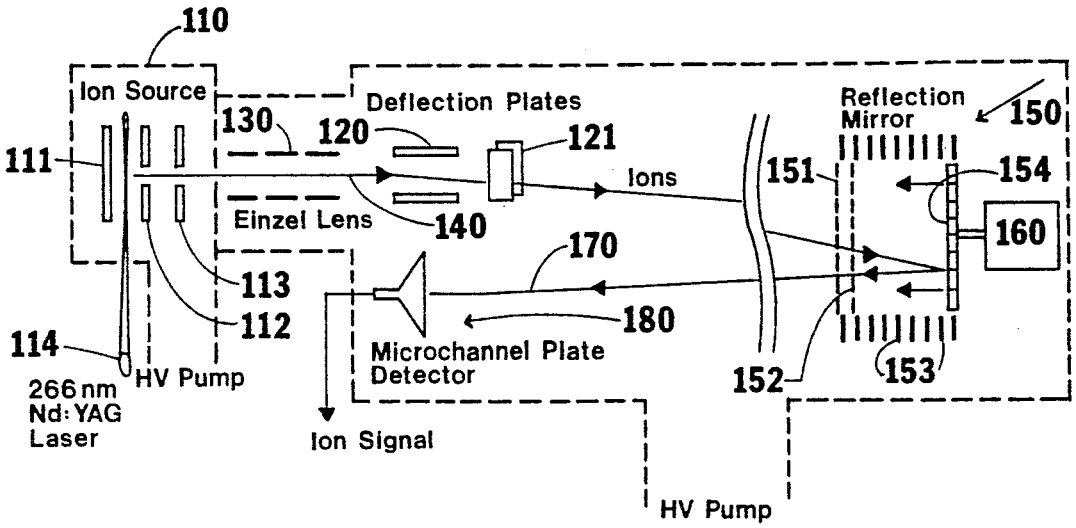
FIG. 1*a* is a diagrammatic representation of a reflectron time-of-flight mass spectrometer with a movable SID surface according to the invention.

A mass spectrometer system according to the invention is generally illustrated in FIG. 1*a* and includes an ion source 110, an ion optical system, that includes an einzel lens 130, steering plates 120, and ion deflection lens 121, positioned after the ion source to focus the parent ion beam 140 into the reflectron 150. In this embodiment, ions are generated in the ion source that contains ground electrode 113 and charged electrodes 112 and 111, by laser photoionization of a sample, by desorption laser (not shown) and ionization laser 114, see Zare et al., U.S. Pat. No. 4,988,879, issued Jan. 29, 1991, incorporated herein by reference, or by direct laser desorption (not shown). Other conventional means of generating ions, including electrospray, electron impact, chemical ionization and field ionization can be employed.

An embodiment of the present invention was built using a reflection time-of-flight mass spectrometer (R. M. Jordon Co.), modified to include an ion source for laser desorption and laser photoionization, ion deflection lens for ion selection, and a stainless steel collision surface for surface induced dissociation.

The reflectron comprises two grid decelerating electrodes 151 and 152 arranged at the inlet of the reflectron. The decelerating electrodes are positioned within the aperture of a series of diaphragm ring shaped reflectron lens (or mirrors) 153. Mounted in the aperture behind decelerating electrode 152 is a moveable surface-induced dissociation (SID) surface 154 that is connected to a conventional mechanism 160 so that the surface can be maneuvered within the aperture. The operating parameters of the system, including the SID surface position, were optimized to achieve high mass spectra resolution and sensitivity. Once positioned, however, the SID surface remains stationary during the analysis. In addition, conventional means are employed to vary the potential on the movable surface. In the geometry employed, an ion of one particular mass, e.g., a parent ion, collides with the movable surface 154 and its fragments are then accelerated along flight path 170 to microchannel plate detector 180.

Surface induced dissociation was achieved in the above described reflectron time-of-flight instrument. Specifically, the surface was inserted to approximately the third plate from the front end of the reflectron. Individual parent ions were selected using the pulsed deflection lens prior to the reflectron, with mass separation taking place based on mass dependent flight times after ion formation and subsequent acceleration. These mass selected ions were deflected to the lower portion of the SID surface, directly in line with the detector. This is consistent with ions coming off the surface with a near normal distribution. Ions were made to strike the surface by decreasing the potential on the SID surface to below that of the initial ion acceleration energy (typically 2–5 keV), with the collision energy given by the difference between these two values. Thus an infinite range of collision energies from zero eV up to the ion acceleration energy (2–5 keV) are possible. Upon collision, fragment ions that are formed as a result of the collisions are accelerated to the detector and separated based on their mass-dependent flight times (analogous to a linear time-of-flight instrument). Temporal separation of these ions is shifted by the flight time of the parent ion to the surface (~60% of the total flight time of the undissociated parent ion in this instrument), so that these ions arrive at times that differ from undeflected fragment ions formed in the source or by metastable decay in the flight tube. Because the surface is an "in-line" device, it can readily be retracted for the acquisition of high resolution mass spectra. An alternate method would be to raise the potential on the surface so that ions no longer strike it. This could be done rapidly and under computer control so that MS and MS/MS spectra could alternately be acquired rapidly in time. The collision surface material can easily be changed or manipulated (e.g. heated).

A reflectron time-of-flight mass spectrometer as shown in FIG. 1*a* was used in these experiments. SID spectra were measured with the surface inserted into the reflectron; ions were made to undergo collisions by reducing the potential on the surface to below that of the ion acceleration energy (~2.6 kV). Ions produced at the surface are subsequently accelerated with mass separation taking place based on their flight times to the detector.

Samples for analysis were introduced through a gas-phase inlet system and thereafter photoionized using 226-nm photons from a Nd:YAG laser (Continuum Electrooptics, Santa Clara, Calif., Model 661-30); for the phenanthrene experiments, laser power (~$10^6$ W/cm$^2$) was reduced so that parent ions were formed exclusively. Similar SID spectra were obtained with higher laser power (up to $10^8$ W/cm$^2$) using a pulsed deflection lens to select only the parent ion. Source pressure with phenanthrene and 4-methyl anisole sample introduction was $\sim 4\times10^{-7}$ torr and $\sim 2\times10^{-6}$ torr, respectively. The main flight chamber with the collision surface was maintained at $\sim 2\times10^{-8}$ torr.

Figure 2:
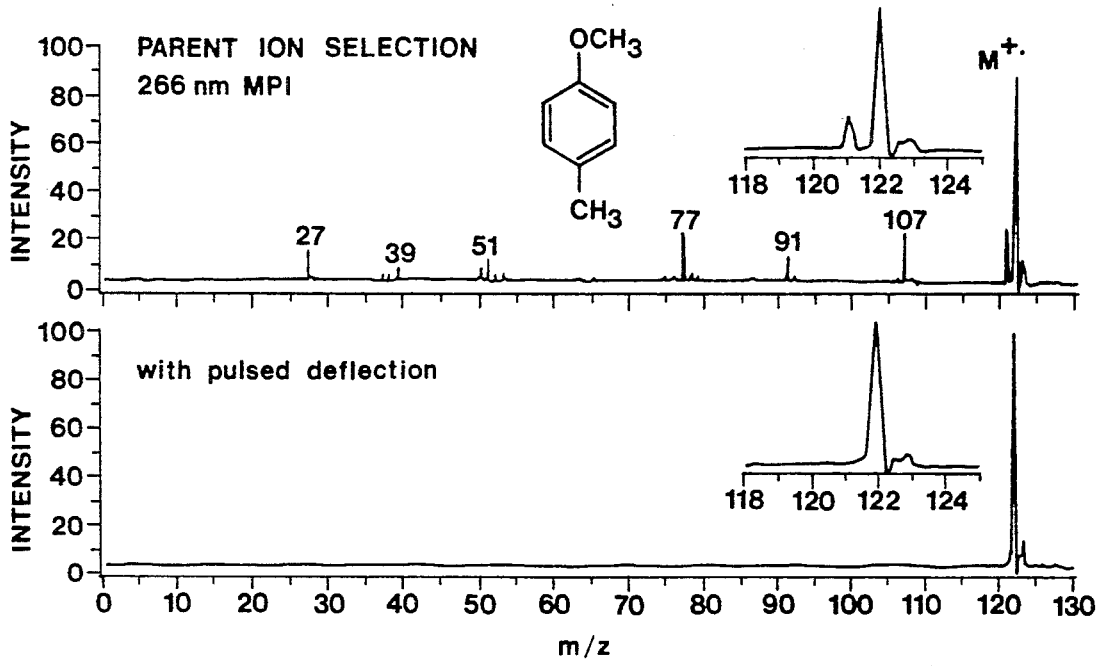
FIG. 2 is a 266-nm multiphoton ionization spectrum of 4-methyl anisole with (bottom) and without (top) pulsed deflection of fragment ions formed in the ion source. Expansion of molecular ion region inset.
Figure 3:
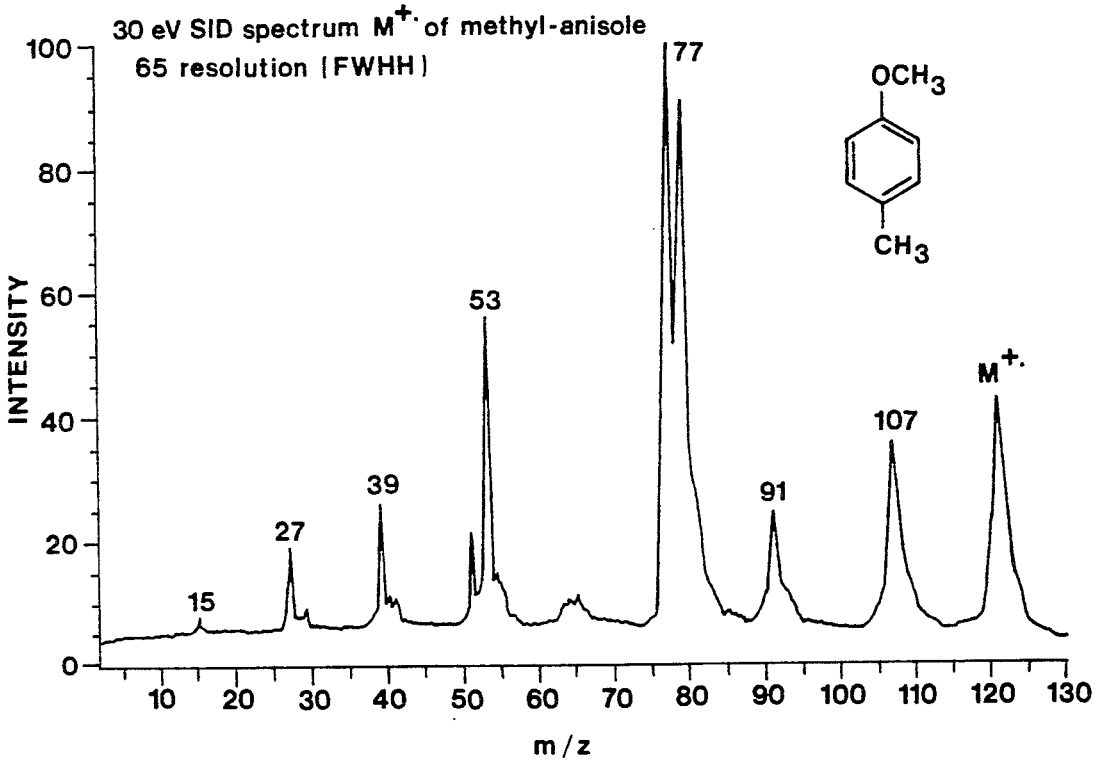
FIG. 3 is a 30 eV surface induced dissociation spectrum of the molecular ion, Mhu +, of 4-methyl anisole.
Figure 4:
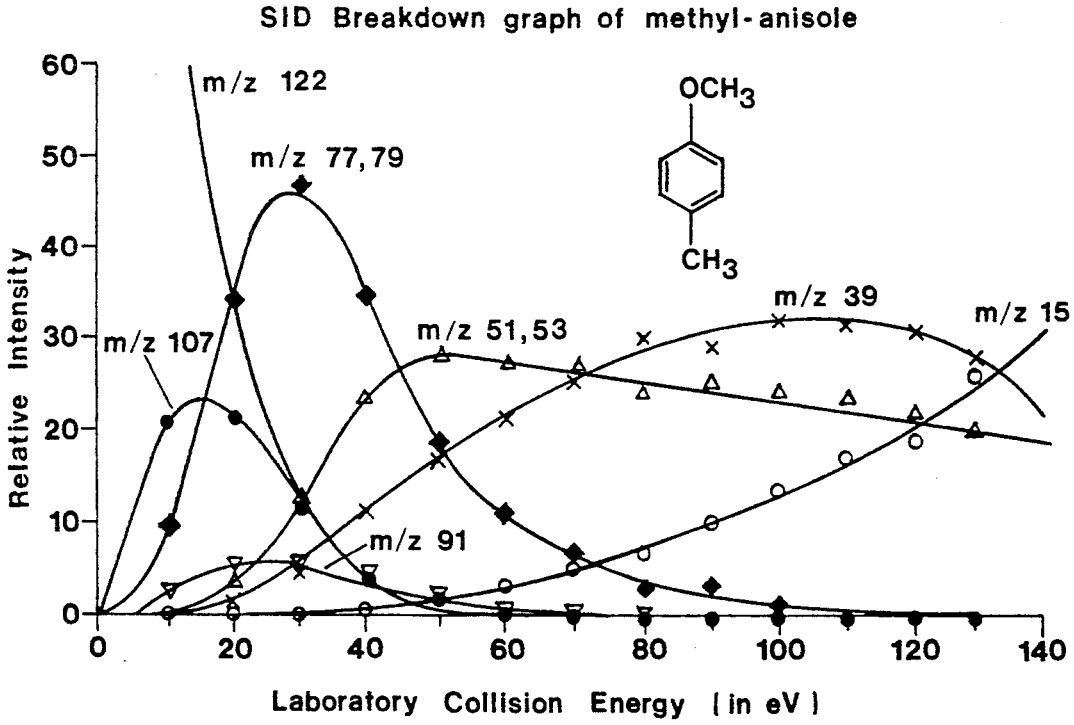
FIG. 4 is a breakdown curve for 4-methyl anisole showing surface induced dissociation product ion abundance as a function of laboratory collision energy (in eV) for selected ions.

The surface induced dissociation process is illustrated with 4-methyl anisole in FIGS. 2–4. FIG. 2 (top) is a 266-nm multiphoton ionization spectrum of 4-methyl anisole, and shows characteristic fragmentation expected for this molecule (Table I).

TABLE I

Fragmentation Of 4-Methyl Anisole

| Ion | | m/z | ap[1] (eV) |
|---|---|---|---|
| $(C_8H_{10}O)^{+\cdot}$ | $(M^{+\cdot})$ | 122 | ~7.9 (ionization pot.) |
| $(C_8H_9O)^+$ | (—H) | 121 | 11.9 |
| $(C_7H_7O)^+$ | (—$CH_3$) | 107 | 10.8 |
| $(C_7H_7)^+$ | (—$OCH_3$) | 91 | 12.6 |
| $(C_6H_5)^+$ | | 77 | |
| $(C_4H_3)^+$ | | 51 | |
| $(C_3H_3)^+$ | | 39 | 14.7 (from benzene) |
| $(C_2H_3O)^+$ | | 27 | |

[1]Appearance potentials are from Rosenstock, H.M.; Draxl, K.; Steiner, B.W.; Heron, J.T. J. Phys. Chem. Refer. Data 1977, 6, Suppl. 1.

FIG. 2 (bottom) shows the results of the parent ion selection, in which all fragment ions formed in the ion source are deflected using the ion deflection lens. Note that the ion, $(C_8H_9O)^+$ (corresponding to loss of hydrogen), which differs from the parent ion mass by one Da, can be readily removed (FIG. 2, insets). The selected parent ions (FIG. 2, bottom), are then made to collide with the surface by inserting the surface into the reflectron, deflecting the ion beam to the lower portion of the SID surface, and lowering the potential on the surface to below that of the ion acceleration energy. The results of 30 eV collisions are shown in FIG. 3. This ion undergoes extensive fragmentation at this collision energy, producing characteristic fragmentation for this compound. The SID efficiency for this ion (sum of the abundance of the SID dissociation products divided by the abundance of uncollided parent ions) at this energy is ~15%.

Such SID spectra can be obtained for a multiplicity of laboratory collision energies, and the abundance of fragment ions plotted at each energy to generate what is called a breakdown curve. As demonstrated by Cooks and coworkers (Cooks et al., *Int. J. Mass Spectrom. Ion Processes* 1990, 100, 209–265 and references cited therein.), such graphs can be useful for distinguishing isomeric ions that show similar fragmentation at a given collision energy. A breakdown graph for the molecular ion of 4-methyl anisole is shown in FIG. 4. Complete loss of molecular ions can be effected with collision energies above 60 eV. The relatively low energy processes, loss of $CH_3$ and $OCH_3$, reach a maximum at approximately 15 eV and 23 eV respectively. The higher energy formation of $C_3H_3^+$ reaches a maximum at approximately 100 eV. Secondary ion emission, originating from hydrocarbon pump-oil on the surface, is found to occur with collision energies above approximately 200 eV. Because of the wide range of collision energies possible with this method, this technique is also well suited for surface analysis and characterization with mass selected ion probes. In this process, mass selected ions generated from a sample of known material are accelerated and focused onto the SID surface with sufficient energy to cause fragmentation. The SID surface, comprising of an unknown substance of interest, will cause the formation of characteristic ion fragments, adsorbate ions, or both that are then separated by the detector.

Molecular ions of PAH's can be made to undergo extensive fragmentation upon collision with a stainless-steel surface. Dissociation of the molecular ion of phenanthrene $(C_{14}H_{10})^{+\cdot}$ with collision energies between 0–200 eV produces fragmentation comparable to that reported for its isomer, anthracene, although fragmentation appears more extensive, consistent with higher internal energy deposition with the present near-normal collisions. With 120 eV collisions (FIG. 5), the principal dissociation is loss of acetylene (appearance potential ~16 eV), the formation of which is ~8 eV above the ionization potential, indicating substantial internal energy deposition at this collision energy. The loss of H or $H_2$ from undissociated molecular ions was not resolved, although broadening in this peak indicates the presence of these ions. Higher energy surface collisions deposit additional internal energy into the ions, forming species such as $C^+$. This high internal energy deposition should make possible the dissociation of large singly charged ions of biomolecules, such as those formed by matrix assisted laser desorption.

The overall SID efficiency for phenanthrene parent ion is 7% with 80 eV collisions. Collection of ions from the surface should be quite high owing to the high extraction fields (~700 V/mm) and the open flight path to the detector. Dissociation efficiencies for larger, even-electron peptide ions formed by laser desorption as high as 50%, have been found, indicating that the principal loss of ion signal for the odd-electron precursor ions is caused by neutralization at the surface.

Figure 5:
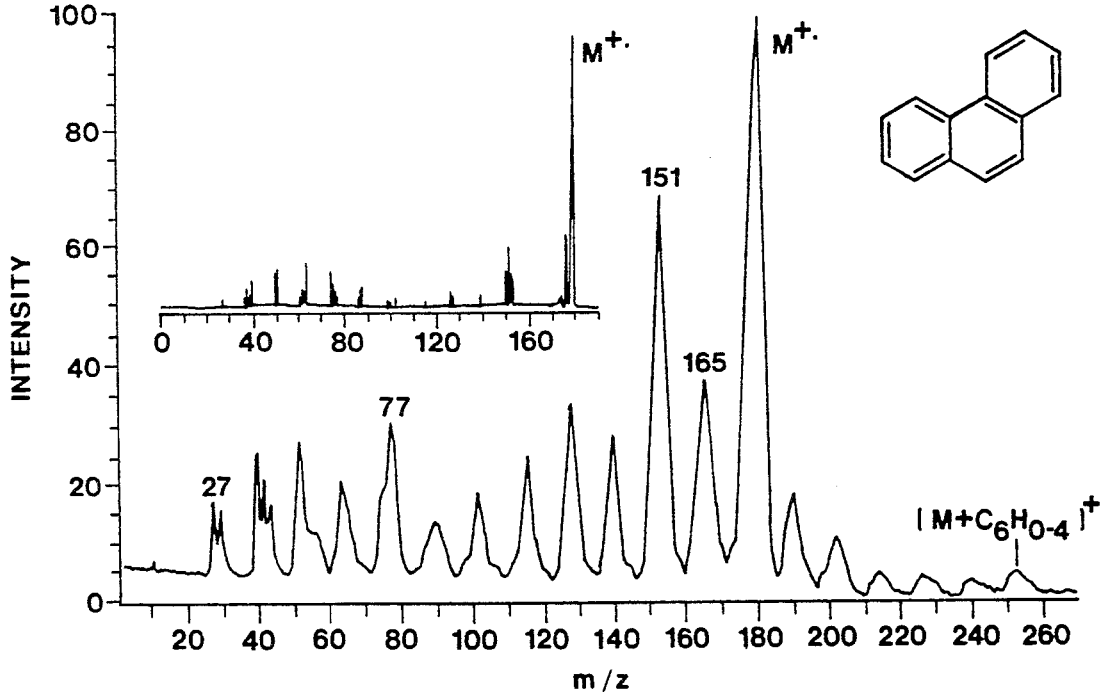
FIG. 5 is a surface-induced dissociation spectrum of the molecular ion of phenanthrene with 120 eV collision energy; high power 226 nm multiphoton ionization spectrum inset.

In addition to dissociation and neutralization, abundant pick-up by the molecular ion of $C_1H_n$–$C_6H_n$ with collision energies between 40 and 160 eV was observed; the maximum intensity for these attachment reactions occurs around 120 eV (FIG. 5). At this energy, pick-up of $C_1H_n$–$C_4H_n$ is substantially higher than observed previously. See Bier et al., *Int. J. Mass Spectrom. Ion Proc.*, 1990, 103, 1–19; Schey et al., *Int. J. Mass Spectrom. Ion Proc.*, 1989, 94, 144; and Ding and Wysocki, *Proc. 39th ASMS Conf. on Mass Spectrom. & Allied Topics*, May 1991, Nashville, Tenn. Attachment of $C_5H_n$ and $C_6H_n$ has not been reported before. The total ion abundance of these reactions is 11% that of fragmentation.

The same attachment reactions for naphthalene molecular ions $(C_{10}H_8)^{+\cdot}$ was found. No ion signal is observed above the $(M+C_6H_4)^+$ ion (m/z 204 for naphthalene). This indicates that secondary ion emission (i.e., sputtering) of surface adsorbates does not contribute measurable ion signal to the higher mass $C_3H_n$–$C_6H_n$ attachment reactions observed with phenanthrene molecular ions, i.e., this ion signal originates exclusively from ion-adsorbate reactions. A likely source of these higher mass adducts is polyphenylether which is used as the oil in the untrapped diffusion pumps, and is ubiquitous on the surfaces of the vacuum chamber.

With the time-of-flight measurements, no measurable shift in flight time or distortion in peak shapes for these species was found, indicating the reaction time on the surface must be substantially less than the 160 ns peak width (FWHM) observed for the $(M+C_6H_n)^+$ ions. Unresolved masses differing by one hydrogen atom appear to be the major contribution to the peak widths for these ion-adsorbate attachment reactions; to resolve these individual ions, a five-fold improvement in resolution is required.

Figure 1B:
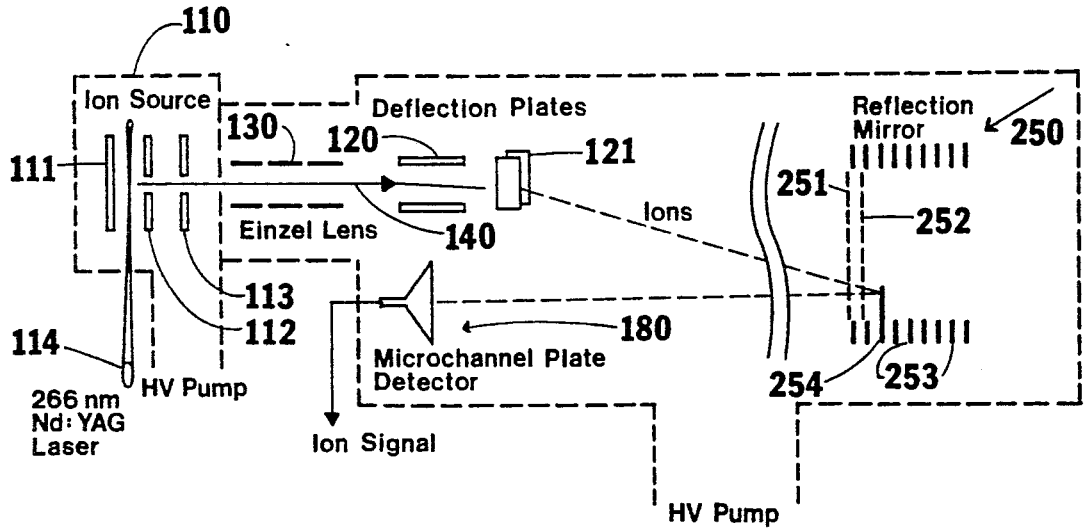
FIG. 1*b* is a diagrammatic representation of a reflectron time-of-flight mass spectrometer with a non-movable SID surface according to the invention.

Referring to FIG. 1*b* is another embodiment of the invention which employs a reflectron with a non-movable surface for SID. This MS system employs the same ion source, ion optical system and microchannel plate detector as the MS system described in FIG. 1*a*. In this embodiment, the reflectron 250 comprises two grid decelerating electrodes 251 and 252 arranged at the inlet of the reflectron. The decelerating electrodes are positioned within the aperture of a series of diaphragm ring lenses (or mirrors) 253. In this embodiment, the third reflectron plate 254 is extended partially into the reflectron aperture. Parent ions 140 deflected by deflection plates 120 can be made to strike the non-movable reflectron plate 254. The potential of the plate 254 can be adjusted to cause the ions to collide with it. Product ions would then be detected by the microchannel detector 180. SID with this embodiment has the advantage that there are no movable parts; thus, by simply adjusting the potential on the deflection plates 120, high resolution mass spectra, and tandem mass spectra can be acquired alternately in time. Since the potential of the deflection plates can be adjusted in nanoseconds ($10^{-9}$ s), virtually no sample would be lost switching between these two modes of operation.

It is to be understood that while the invention has been described above in conjunction with preferred specific embodiments, the description and examples are intended to illustrate and not limit the scope of the invention, which is defined by the scope of the appended claims.

It is claimed:

1. A time of flight mass spectrometer, comprising:

a parent ion source means for generating a beam of parent ions that are accelerated along a flight path; and an ion reflectron positioned along said flight path, wherein said ion reflectron comprises a movable surface with an adjustable potential, said movable surface adaptable by proper alignment of its position along said flight path, by adjustment of said surface potential, or both, to cause said beam of parent ions to strike said movable surface, so that collision of said parent ions with said movable surface dissociates said parent ions into ion fragments.

2. The time of flight mass spectrometer as defined in claim 1 wherein said ion reflectron further comprises one or more reflectron lenses.

3. The time of flight mass spectrometer as defined in claim 2 further comprising:

detector means for separating the ion fragments; and lens means for focusing said ion fragments into said detector means.

4. The time of flight mass spectrometer as defined in claim 3 wherein said parent ion source means comprises:

means for generating primary ions from a sample; and parent ion selection lens for selecting individual parent ions from said primary ions.

5. The time of flight mass spectrometer as defined in claim 4 wherein said reflectron lenses comprise a series of plates each with an aperture of substantially the same diameter, with each plate positioned one behind the other so that said apertures define a cylindrical passage into which said beam of parent ions enters, and wherein said movable surface comprises a substantially flat, stainless steel plate that can be positioned within said entrance.

6. The time of flight mass spectrometer as defined in claim 5 wherein said movable surface potential remains fixed during mass analysis.

7. The time of flight mass spectrometer as defined in claim 5 wherein said movable surface potential varies during mass analysis.

8. The time of flight mass spectrometer as defined in either claim 6 or 7 wherein said movable surface moves during mass analysis.

9. A time of flight mass spectrometer, comprising:

a parent ion source means for generating a beam of parent ions that are accelerated along a flight path; and an ion reflectron positioned along said flight path, wherein said ion reflectron comprises a non-movable surface with an adjustable potential, said non-movable surface adaptable by proper alignment of its position along said flight path, by adjustment of said surface potential, or both, to cause said beam of parent ions to strike said non-movable surface, so that collision of said parent ions with said non-movable surface dissociates said parent ions into ion fragments, said ion reflectron further comprises one or more reflectron lenses and wherein said non-movable surface is connected to one of said reflectron lenses.

10. The time of flight mass spectrometer as defined in claim 9 further comprising:

detector means for separating the ion fragments; and lens means for focusing said ion fragments into said detector means.

11. The time of flight mass spectrometer as defined in claim 10 wherein said parent ion source means comprises:

means for generating primary ions from a sample; and parent ion selection lens for selecting individual parent ions from said primary ions.

12. The time of flight mass spectrometer as defined in claim 11 wherein said reflectron lenses comprise a series of plates each with an aperture of substantially the same diameter, with each plate positioned one behind the other so that said apertures define a cylindrical passage into which said beam of parent ions enters, wherein said non-movable surface comprises a substantially flat, stainless steel member that is connected to one of said plates so that said member extends into said passage.

13. The time of flight mass spectrometer as defined in claim 12 wherein said non-movable surface potential remains fixed during mass analysis.

14. The time of flight mass spectrometer as defined in claim 12 wherein said non-movable surface potential varies during mass analysis.

15. A method of analyzing the mass of a sample, comprising the steps of:

generating primary ions from said sample;

selecting individual parent ions from said primary ions;

focusing a beam of said parent ions along a flight path onto an ion reflectron that comprises one or more reflectron lenses and a movable surface with an adjustable potential, said movable surface adaptable by proper alignment of its position along said flight path, by adjustment of said surface potential, or both, to cause said beam of parent ions to strike said movable surface, so that collision of said parent ions with said movable surface dissociates said parent ions into ion fragments; and focusing said ion fragments into a detector for separation.

16. A method of analyzing the mass of a sample, comprising the steps of:

generating primary ions from said sample;

selecting individual parent ions from said primary ions;

focusing a beam of said parent ions along a flight path onto an ion reflectron that comprises one or more reflectron lenses and a movable surface with an adjustable potential and with surface-adsorbed molecules deposited onto said movable surface, said movable surface adaptable by proper alignment of its position along said flight path, by adjustment of said surface potential, or both, to cause some of said parent ions to strike said movable surface and react with said adsorbed molecules to form ion-adsorbate molecules that are thereafter reflected off said movable surface; and focusing said ion-adsorbate molecules into a detector for separation.

17. A method of analyzing the mass of a sample, comprising the steps of:

generating primary ions from said sample;

selecting individual parent ions from said primary ions;

focusing a beam of said parent ions along a flight path onto an ion reflectron that comprises one or more reflectron lenses and a movable surface with an adjustable potential, sufficiently increasing said movable surface potential so that said parent ions are reflected without striking said movable surface;

focusing said deflected parent ions into a detector for separation;

lowering said movable surface potential so that said parent ions strike said movable surface, so that collision of said parent ions with said movable surface dissociates said parent ions into ion fragments; and focusing said ion fragments into said detector for separation.

18. A method of characterizing an unknown material using mass selected ion probes, comprising the steps of:

generating primary ions from a known sample;

selecting individual ion probes from said primary ions;

focusing a beam of said ion probes along a flight path onto an ion reflectron that comprises one or more reflectron lenses and a plate with an adjustable potential, said plate having a layer of said unknown material applied thereto and said plate adaptable by proper alignment of its position along said flight path, by adjustment of said plate potential, or both, to cause said beam of ion probes to strike said layer of unknown material on said plate, so that collision of said ion probes with said layer of unknown material causes dissociation said ion probes into ion fragments or formation of adsorbate ions; and focusing said ion fragments or adsorbate ions into a detector for separation.

19. A method of analyzing the mass of a sample, comprising the steps of:

generating primary ions from said sample;

selecting individual parent ions from said primary ions;

focusing a beam of said parent ions along a flight path onto an ion reflectron that comprises one or more reflectron lenses and a non-movable surface with an adjustable potential, sufficiently increasing said non-movable surface potential so that said parent ions are reflected without striking said movable surface;

focusing said deflected parent ions into a detector for separation;

lowering said non-movable surface potential so that said parent ions strike said non-movable surface, so that collision of said parent ions with said non-movable surface dissociates said parent ions into ion fragments; and focusing said ion fragments into said detector for separation.

* * * * *